US007946857B2

(12) United States Patent
Wang

(10) Patent No.: US 7,946,857 B2
(45) Date of Patent: May 24, 2011

(54) CIRCUIT INTERFACE DEVICE

(75) Inventor: Wei Chung Wang, Taipei County (TW)

(73) Assignee: Kye Systems Corp., San Chung, Taipei (TW)

( * ) Notice: Subject to any disclaimer, the term of this patent is extended or adjusted under 35 U.S.C. 154(b) by 36 days.

(21) Appl. No.: 12/585,720

(22) Filed: Sep. 23, 2009

(65) Prior Publication Data

US 2010/0267285 A1 Oct. 21, 2010

(30) Foreign Application Priority Data

Apr. 15, 2009 (TW) ..... 98112566 A

(51) Int. Cl.
*H01R 12/00* (2006.01)

(52) U.S. Cl. ..... 439/76.1

(58) Field of Classification Search ..... 439/76.1
See application file for complete search history.

(56) References Cited

U.S. PATENT DOCUMENTS 7,165,998 B2 1/2007 Lee et al.
7,407,390 B1 * 8/2008 Ni ..... 439/76.1
7,802,997 B2 * 9/2010 Kuo ..... 439/76.1

* cited by examiner

*Primary Examiner* — Ross N Gushi
(74) *Attorney, Agent, or Firm* — Bacon & Thomas, PLLC

(57) ABSTRACT

A circuit interface device is presented. A circuit board is secured by a circuit board cover, a plurality of electrical contacts is disposed on the circuit board, and a connector cover is coupled to a front end of the circuit board, such that a socket disposed at one end of the connector cover is corresponding to an upper side of the electrical contacts of the circuit board, thereby forming a connector of the circuit interface device. As such, through a structural design of buckling the connector cover on the circuit board without completely covering the connector cover on outer edge of the circuit board, a thickness of the connector cover covering the circuit board cover is reduced.

10 Claims, 16 Drawing Sheets

CIRCUIT INTERFACE DEVICE

CROSS-REFERENCE TO RELATED APPLICATIONS

This non-provisional application claims priority under 35 U.S.C. §119(a) on Patent Application No(s). 098112566 filed in Taiwan, R.O.C. on Apr. 15, 2009, the entire contents of which are hereby incorporated by reference.

BACKGROUND OF THE INVENTION

1. Field of Invention

The present invention relates to a circuit interface device, and more particularly to a thin circuit interface device having a reduced length.

2. Related Art

A Universal Serial Bus (USB) is a standard computer connection interface, which unifies the connectors of various computer peripherals. For example, the communication interface, printer interface, display output, audio output and input devices, and storage equipment (such as an external portable hard disk) all use the USB interface specification. With the characteristics of Plug-and-Play and Hot Swap, the computer peripherals having the USB can be connected or detached at any time in a state that an operating system is booted and runs normally without shutting down or restarting the power supply of a computer host.

Early peripherals applying the USB are portable peripherals such as the portable disk, multimedia player (MP3), recorder pen or wireless receiver, in which a USB connector is soldered onto a circuit board, relevant electronic elements (such as the chips, flash memory, and wireless transmitter) are disposed on the circuit board, and a plastic housing completely covers the circuit board. In use, it is only necessary to insert the USB connector exposed out of one end of the plastic housing into a corresponding socket of the computer host to perform the operation of transmitting relevant signals.

However, at present, the volume of the portable peripherals is required to be light, thin, short, and small, such that users can take the peripherals conveniently. In the structural design described above, as the USB connector is soldered onto the circuit board, the overall length of a portable peripheral may increase due to the parallel design of the connector and the circuit board. Furthermore, when the plastic housing covers the circuit board, in order to accommodate the height of the electronic elements on the circuit board, it is necessary to raise the height of the accommodation space of the plastic housing, thereby causing the increase of the overall thickness of the portable peripheral.

In order to eliminate the above defects, related industries have also brought forward a number of innovations. For example, U.S. Pat. No. 7,165,998 disclosed an improved structure of a USB application apparatus, the design concept of which is to achieve the efficacy of reducing the overall length of the USB application apparatus by using a two-layer circuit board. However, it also brought about a problem on the other hand. The electrical connection contacts of the USB application apparatus are directly disposed on the circuit board so as to be directly electrically connected to the USB socket of the computer through the circuit board; however, since the circuit board is assembled in the housing layer and no support structure is provided below the circuit board, the circuit board may be suspended, and the USB application apparatus cannot be firmly disposed into the socket. Therefore, in U.S. Pat. No. 7,165,998, a support construction and a front protective layer are designed to support the circuit board, and a housing layer is required to cover the connector. However, the assembly of the circuit board, the support construction, and the front protective layer of the prior art still cannot meet the structural strength requirements.

Although the above conventional USB application apparatus reduces the entire volume through the design of the two-layer circuit board, so as to shorten the overall length thereof. However, since the USB application apparatus uses a plurality of elements to support the circuit board, and the structure is quite complicated, the manufacture and processing is very difficult. Further, if the support construction and the front protective layer are assembled in the housing layer through gluing, although the effect of compact bonding is achieved, the assembly needs more work hours and labors, making the assembly process more complicated. Additionally, since the USB application apparatus is compactly bonded through gluing, the USB application apparatus cannot be disassembled freely, and if the housing layer is detached, damage to the USB application apparatus is generated, resulting in that the USB application apparatus cannot be used, and causing a heavy burden on the maintenance.

Additionally, Logitech develops a USB peripheral with a product model V550 Nano. This structure mainly uses the USB peripheral as a receiver of a wireless peripheral input device. The receiver of Logitech has a two-layer circuit board, uses two plastic pieces to clip one end of the two-layer circuit board, and uses a metal housing to cover the exposed two-layer circuit board, so as to constitute a receiver with an integrated profile. In such a manner, the volume of the receiver is reduced to the length of a common USB plug.

However, the receiver developed by Logitech uses plastic pieces and the metal housing to completely cover the circuit board, such that the thickness of the receiver cannot be made thinner, and the receiver cannot match different external designs, for example, cannot use different materials and colors to provide an appearance with a better sense of design according to the market demands. Therefore, it is a problem that needs to be solved urgently for persons in related fields to make the volume of the USB peripheral thinner and have the efficacy of high structural strength at the same time.

SUMMARY OF THE INVENTION

Currently, known USB peripherals still cannot meet the demands for thinner thickness and high structural strength in assembly. Therefore, in view of the above problems, the present invention is a circuit interface device, which solves the problems of assembly strength and reduced thickness of the USB application apparatus of the prior art.

The circuit interface device according to the present invention is applied to an electronic device, and the electronic device has a circuit interface socket. The circuit interface device comprises a circuit board cover, a circuit board, and a connector cover. The circuit board is secured by the circuit board cover, at least one electronic element is disposed on two sides of the circuit board respectively, and a plurality of electrical contacts is disposed on a side surface of the circuit board. A socket is disposed at one end of the connector cover, and the connector cover is coupled to a front end of the circuit board, such that the socket of the connector cover is corresponding to an upper side of the plurality of electrical contacts of the circuit board, and thus the connector cover forms a connector. The circuit interface device is inserted in the circuit interface socket of the electronic device with the connector.

In the circuit interface device according to an embodiment of the present invention, at least one notch is disposed on the circuit board cover, and after the circuit board is disposed in the circuit board cover, a buckle space is formed between the circuit board and the notch. The connector cover has a combining direction opposite to the circuit board cover, and a buckle piece is correspondingly extended from the connector cover, such that the buckle pieces of the connector cover are inserted into the buckle space along the combining direction, thereby fixing the connector cover on the circuit board.

Therefore, the circuit interface device according to the present invention reduces the length of the circuit board by disposing electronic elements on two sides of the circuit board and accommodating the electronic elements in an accommodation groove on the circuit board cover. The buckle pieces of the connector cover are inserted into the buckle space formed between the circuit board and the circuit board cover. In such a manner, a thickness that the connector cover covers a bottom of the circuit board cover is reduced without completely covering the connector cover on an outer edge of the circuit board, and a firm and compact assembly structure between the connector cover and the circuit board is achieved at the same time.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

The circuit interface device according to the present invention is applied to an electronic device. The electronic device has a circuit interface socket, and the circuit interface device is electrically inserted in the circuit interface socket. In this embodiment, the electronic device may be, but is not limited to, a notebook computer, a desktop computer, or an ultra mobile personal computer (UMPC).

The circuit interface according to the present invention refers to the connection interface that conforms to the USB specification, and can also be applied to the interface specifications such as IEEE1394 and HDMI. The circuit interface device generally refers to wireless receivers (DONGLE) such as the portable disk, Bluetooth receiver, radio frequency receiver, and infrared receiver, or other circuit interface devices that conform to the USB specification. In the following detailed description of the present invention, the circuit interface device having the USB interface is used as the most preferred embodiment of the present invention, and the description is based on the embodiment that the circuit interface device is a wireless receiver of a wireless peripheral input device; however, the circuit interface device of the present invention is not limited to the wireless receiver of the wireless peripheral input device. Certainly, the products applying the present invention and the application scope of the present invention are not limited to the following embodiments of the wireless receiver of the wireless peripheral input device.

Figure 1A:
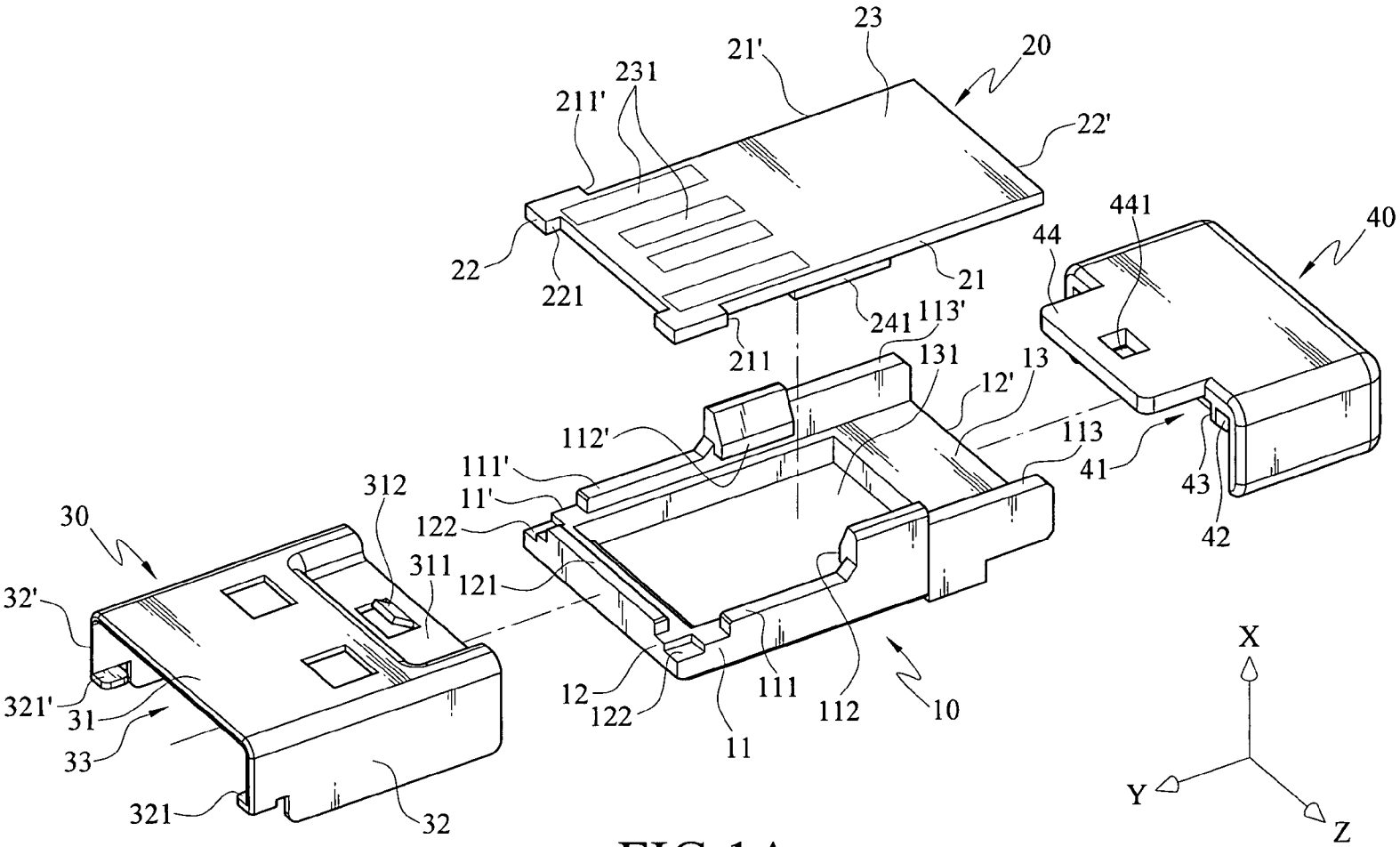
FIGS. 1A-1B are schematic exploded views according to a first embodiment of the present invention.
Figure 1B:
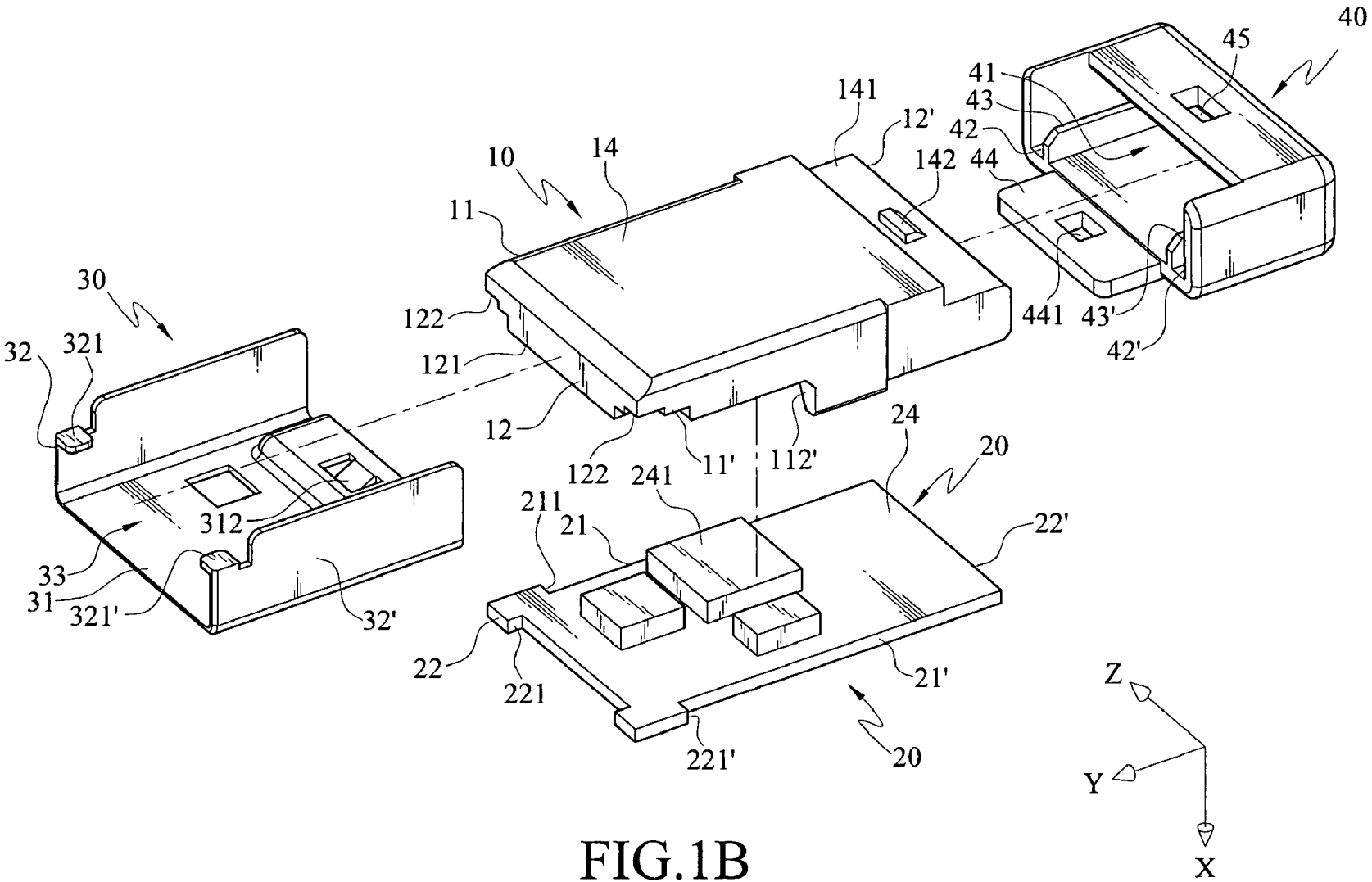

Referring to FIGS. 1A and 1B, the circuit interface device at least comprises a circuit board cover 10, a circuit board 20, a connector cover 30, and an clip cover 40. For the convenience of illustration, X, Y, and Z marked in the figures respectively represent an X-axis direction, a Y-axis direction, and a Z-axis direction, and the X-axis direction, Y-axis direction, and Z-axis direction are perpendicular to one another.

The circuit board cover 10 is a rectangular parallelepiped formed by two opposite long sides 11 and 11' and two opposite short sides 12 and 12'. An assembly plane 13 is defined on an upper surface of the circuit board cover 10 for the circuit board 20 to be stacked and assembled. An accommodation groove 131 is opened in the assembly plane 13 for accommodating electronic elements 241 of the circuit board 20. Additionally, at least one first insertion block 121 is disposed on the short side 12 of the circuit board cover 10, and the first insertion block 121 is higher than the assembly plane 13. Furthermore, a notch 122 is disposed at the corners of the connection ends of the short side 12 and the two long sides 11 and 11' respectively, and the notches 122 are lower than the assembly plane 13.

Further, second insertion blocks 111 and 111' are disposed along the long sides 11 and 11' of the circuit board cover 10 respectively, and hooks 112 and 112' extend upwardly from the ends of the second insertion blocks 111 and 111' respectively. Then, guiding blocks 113 and 113' are erected adjacent to the sides of the hooks 112 and 112', and the guiding blocks 113 and 113' extend from the hooks 112 and 112' to the short side 12'. In addition, a plane 14 is defined at the bottom of the circuit board cover 10, a joint portion 141 having a stage difference relative to the plane 14 is disposed at the short side 12' of the plane 14, and at least one snap block 142 is disposed on the joint portion 141.

The circuit board 20 is disposed on the assembly plane 13 of the circuit board cover 10, and likewise, the circuit board cover 20 is rectangular parallelepiped formed by two opposite long sides 21 and 21' and two opposite short sides 22 and 22', such that the area of the circuit board 20 is substantially the same as that of the assembly plane 13 of the circuit board cover 10.

Furthermore, a first side surface 23 and a second side surface 24 are disposed on the two opposite sides of the circuit board 20 respectively. A plurality of electrical contacts 231 or relevant electronic circuit elements are disposed on the first side surface 23, and the plurality of electrical contacts 231 may be formed by metal copper foils, metal terminals, or other electrically conductive elements. The second side surface 24 is electrically connected to at least one electronic element 241, and the electronic element 241 includes, but is not limited to, electronic elements with signal processing capabilities such as various flash memories, chips, micro antennas, conductors, wireless transmitters, and ICs.

However, the above electronic element 241 is not limited to being disposed on the second side surface 24 of the circuit board 20, and according to different layout demands or designs of the circuit board, the electronic element 241 may be disposed at the first side surface 23 of the circuit board 20, or the electronic element 241 is disposed at the first side surface 23 and the second side surface 24 at the same time, so as to achieve a form of a single-surface or double-surface circuit board.

In addition, one side of the circuit board 20 has an extension, that is, the short side 22, with at least one first insertion groove 221 disposed therein, and the position of the first insertion groove 221 is corresponding to the first insertion block 121 on the circuit board cover 10. Second insertion grooves 211 and 211' are disposed on the long sides 21 and 21' of the circuit board 20 respectively, such that the second insertion blocks 111 and 111' of the circuit board 10 are inserted into the second insertion grooves 211 and 211'.

A connector cover 30 is formed by a base plate 31 and two side plates 32 and 32', and the connector cover 30 may be made of a metal material. The vertical side plates 32 and 32' are formed mainly by downwardly bending two opposite sides of the horizontal base plate 31 respectively, and a socket 33 is formed between the base plate 31 and the two side plates 32 and 32'.

Furthermore, a connection slot 311 is opened on one side of the base plate 31, and at least one catch piece 312 is disposed within the connection slot 311. Buckle pieces 321 and 321' are formed by inwardly bending the other side of the two side plates 32 and 32' away from the connection slot 311 respectively, such that the two buckle pieces 321 and 321' are disposed horizontally towards the socket 33.

The interior of the clip cover 40 has a joint groove 41, and guiding slots 42 and 42' are disposed on the two opposite sides of the joint groove 41 respectively. Partition boards 43 and 43' are disposed between the joint groove 41 and the two guiding slots 42 and 42' respectively, and with the structural design of the partition boards 43 and 43', the guiding slots 42 and 42' form a channel for the corresponding guiding blocks 113 and 113' to slide in.

Furthermore, a connection piece 44 extends from one side of the clip cover 40, and at least one catch hole 441 is disposed on the connection piece 44 for snapping the catch piece 312 of the connector cover 30. A snap hole 45 is disposed at the other side of the connector cover 40 away from the connection piece 44 for snapping the snap block 142 of the circuit board cover 10.

Figure 2A:
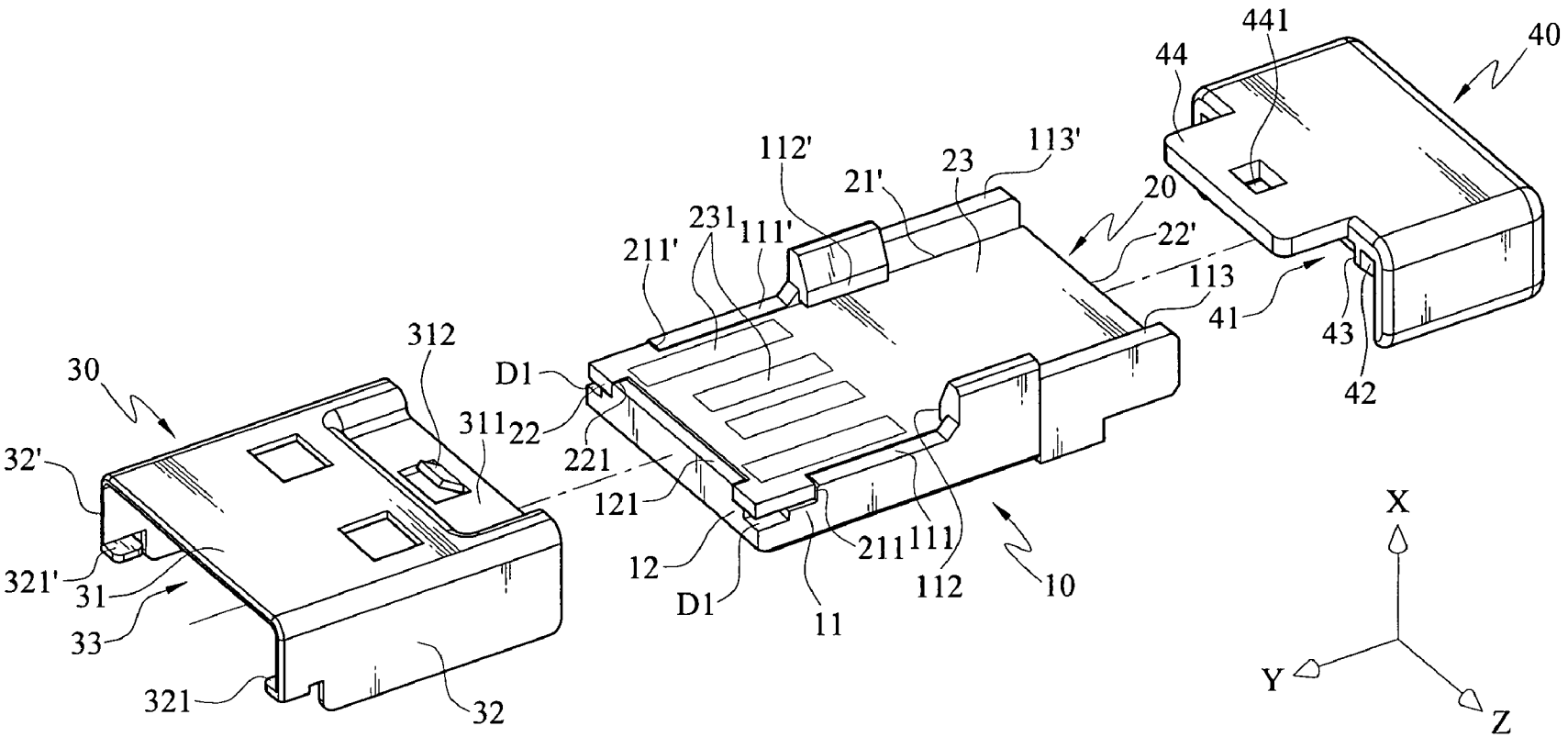
FIGS. 2A-2C are schematic views of the assembly process according to the first embodiment of the present invention.
Figure 2B:
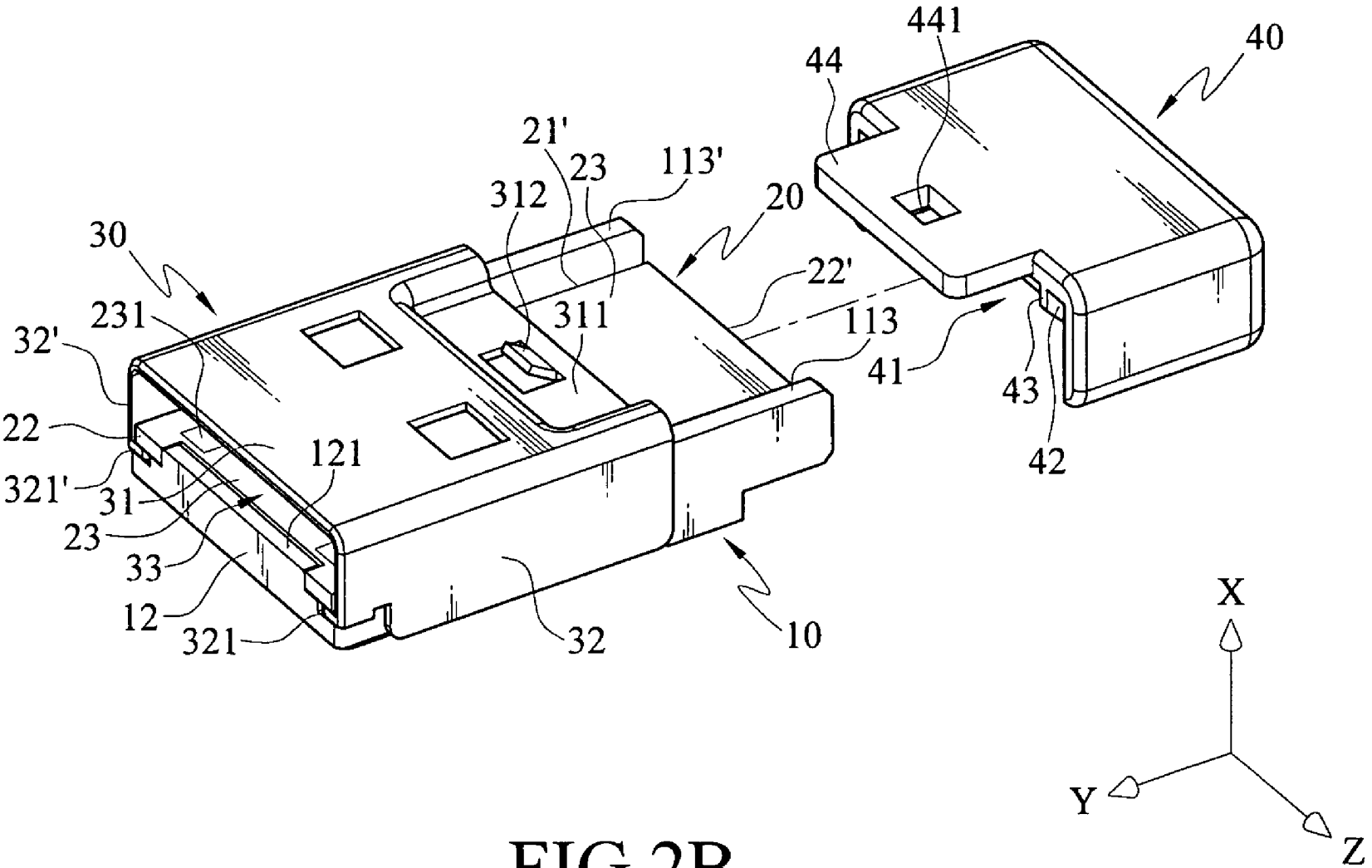
Figure 2C:
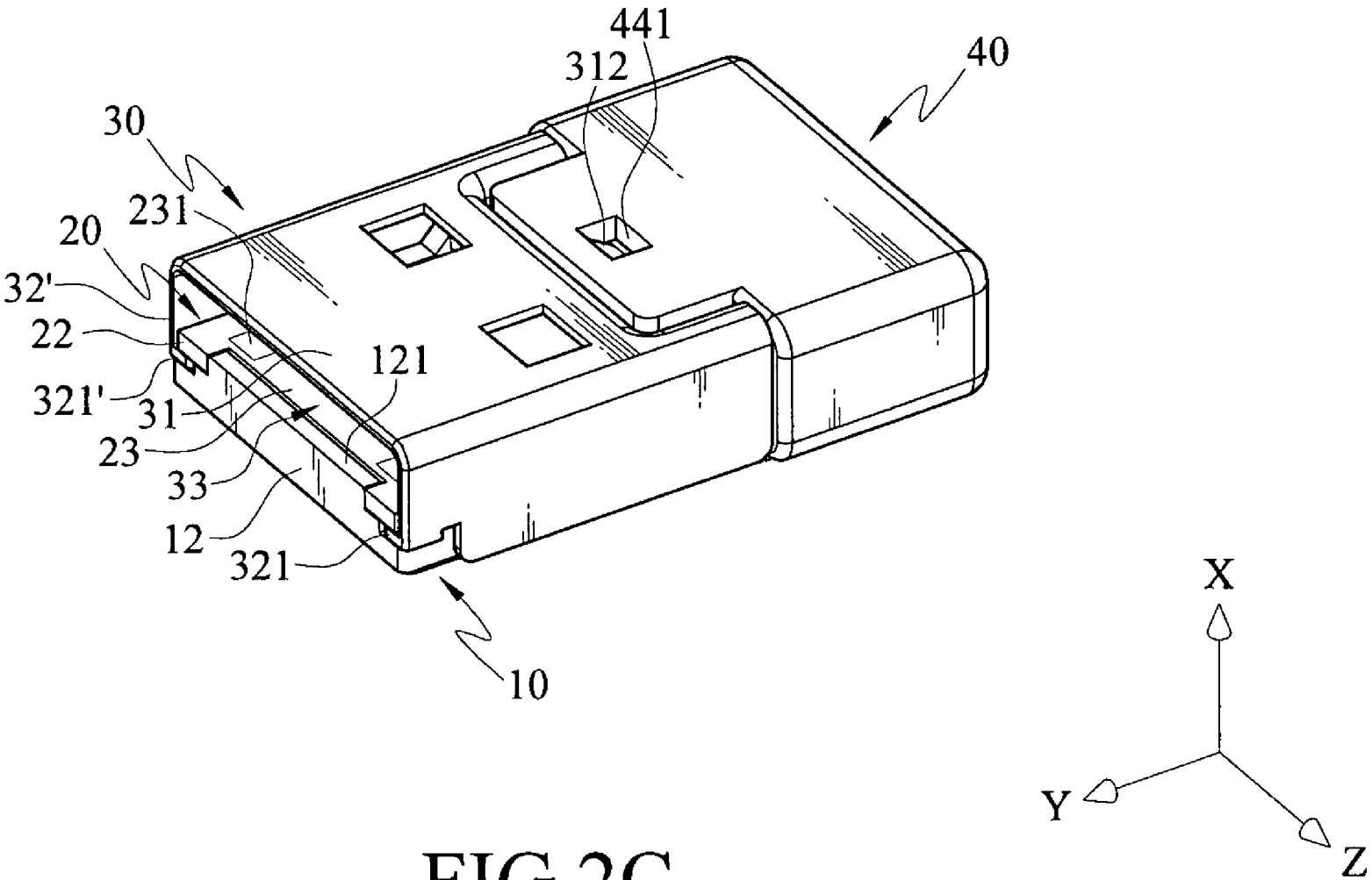

FIGS. 2A to 2C are schematic views of the assembly process according to the first embodiment of the present invention. When the circuit board 20 is secured by the assembly plane 13 of the circuit board cover 10 along the X-axis direction, the first insertion block 121 and the second insertion blocks 111 and 111' of the circuit board cover 10 are inserted into the first insertion groove 221 and the second insertion grooves 211 and 211' of the circuit board 20 respectively. The side surface 24 of the circuit board 20 is flatly attached onto the assembly plane 13, and the electronic element 241 of the second side surface 24 is accommodated inside the accommodation groove 131 opened on the assembly plane 13. The circuit board 20 is tightly snapped and positioned by the hooks 112 and 112' of the circuit board cover 10, so as to prevent the circuit board 20 from being detached from the circuit board cover 10 in the X-axis direction again.

Hence, after the circuit board 20 is mounted on the assembly plane 13 of the circuit board cover 10, a buckle space D1 (as shown in FIG. 2A) is formed between the circuit board 20 and the notches 122 on the circuit board cover 10. The connector cover 30 is assembled at the short side 12 of the circuit board cover 10 along a combining direction, and the combining direction is parallel to the long sides 11 and 11' (as the Y-axis direction in the figures) of the circuit board cover 10. The buckle pieces 321 and 321' of the connector cover 30 are inserted into the buckle space D1 formed between the circuit board 20 and the notches 122, and the connector cover 30 is coupled to a front end of the circuit board 20 by the buckle pieces 321 and 321'. The two side plates 32 and 32' of the connector cover 30 are covered on the two opposite sides of the circuit board cover 10. The socket 33 is corresponding to the upper side of the electrical contacts 231 of the circuit board 20, and the connector cover 30 forms a connector, such that the circuit interface device is inserted into the circuit interface socket with the connector.

Then, the clip cover 40 is assembled towards the short side 12' of the circuit board cover 10 along the combining direction. After the guiding blocks 113 and 113' of the circuit board cover 10 slide into the guiding slots 42 and 42' of the clip cover 40, the joint portion 141 of the circuit board cover 10 may be smoothly buckled into the joint groove 41 of the clip cover 40. The snap block 142 of the joint portion 141 is snapped by the snap hole 45 of the clip cover 40. At the same time, the connection piece 44 of the clip cover 40 is inserted into the connection slot 311 of the connector cover 30, and the catch piece 312 of the connection slot 311 is caught by the catch hole 441 on the connection piece 44. In such a manner, the integral assembly of the circuit interface device of the present invention is completed. In short, the circuit board 20 of the present invention is secured by the circuit board cover 10, the buckle pieces 321 and 321' of the connector cover 30 is coupled to a front end of the circuit board 20, and finally the clip cover 40 at the rear end of the circuit board 20 is respectively coupled to the circuit board cover 10 and the rear end of the connector cover 10 accordingly.

In addition, in this embodiment, the material of the circuit board cover 10 may be, but is not limited to, plastics, plastic steel, or other non-metallic materials. Further, one side of the circuit board cover 10 is exposed. In such a manner, the circuit board cover 10 can change to use different materials and colors according to different appearance demands, improve the appearance and profile design of the circuit interface device, and enhance the market competitiveness.

Moreover, in the embodiment of the present invention, the connector and the circuit interface socket formed by the circuit interface device conform to the USB interface specification. The USB interface specification defines two connectors of different sizes and shapes, namely, Serial A connector and Serial B connector. In this embodiment, the connector complies with the USB specification for the Serial A connector, and the dimensions thereof are 15.7 mm in length, 7.5 mm in width, and 12 mm in height, that is, a rectangular and flat shape, such that the connector can be connected the circuit interface socket with the same specification.

Figure 3A:
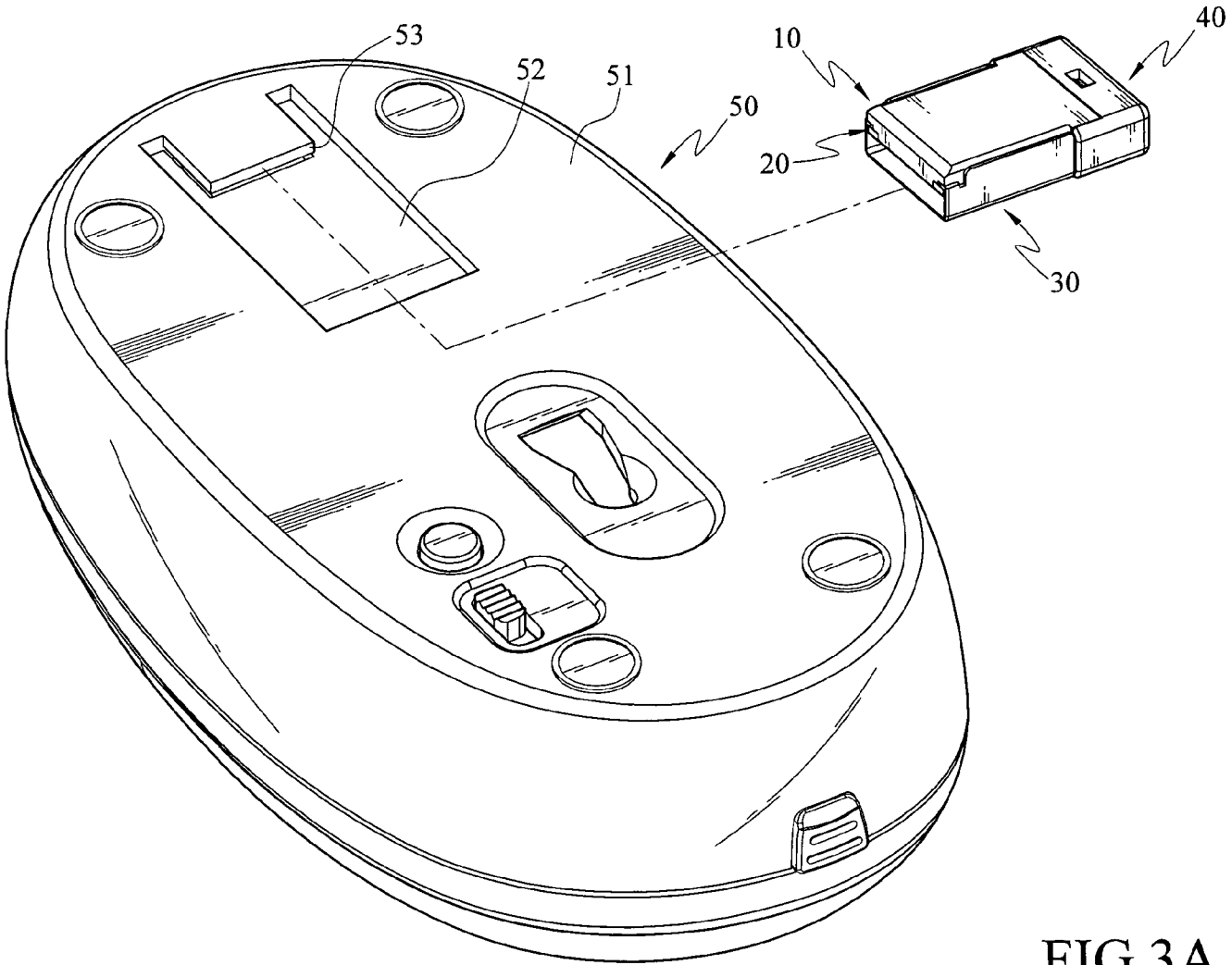
FIGS. 3A-3C are schematic views of motions for assembling the first embodiment of the present invention to a peripheral input device.
Figure 3B:
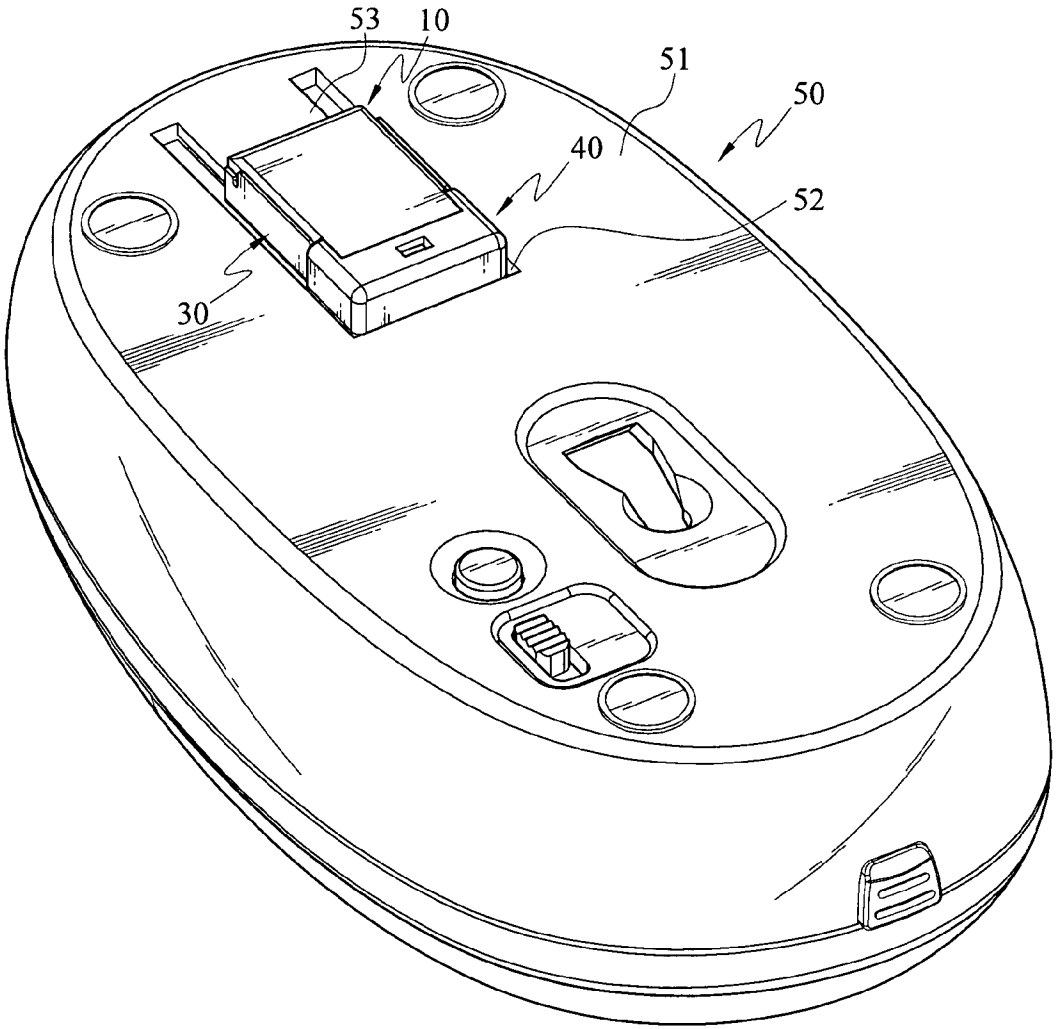
Figure 3C:
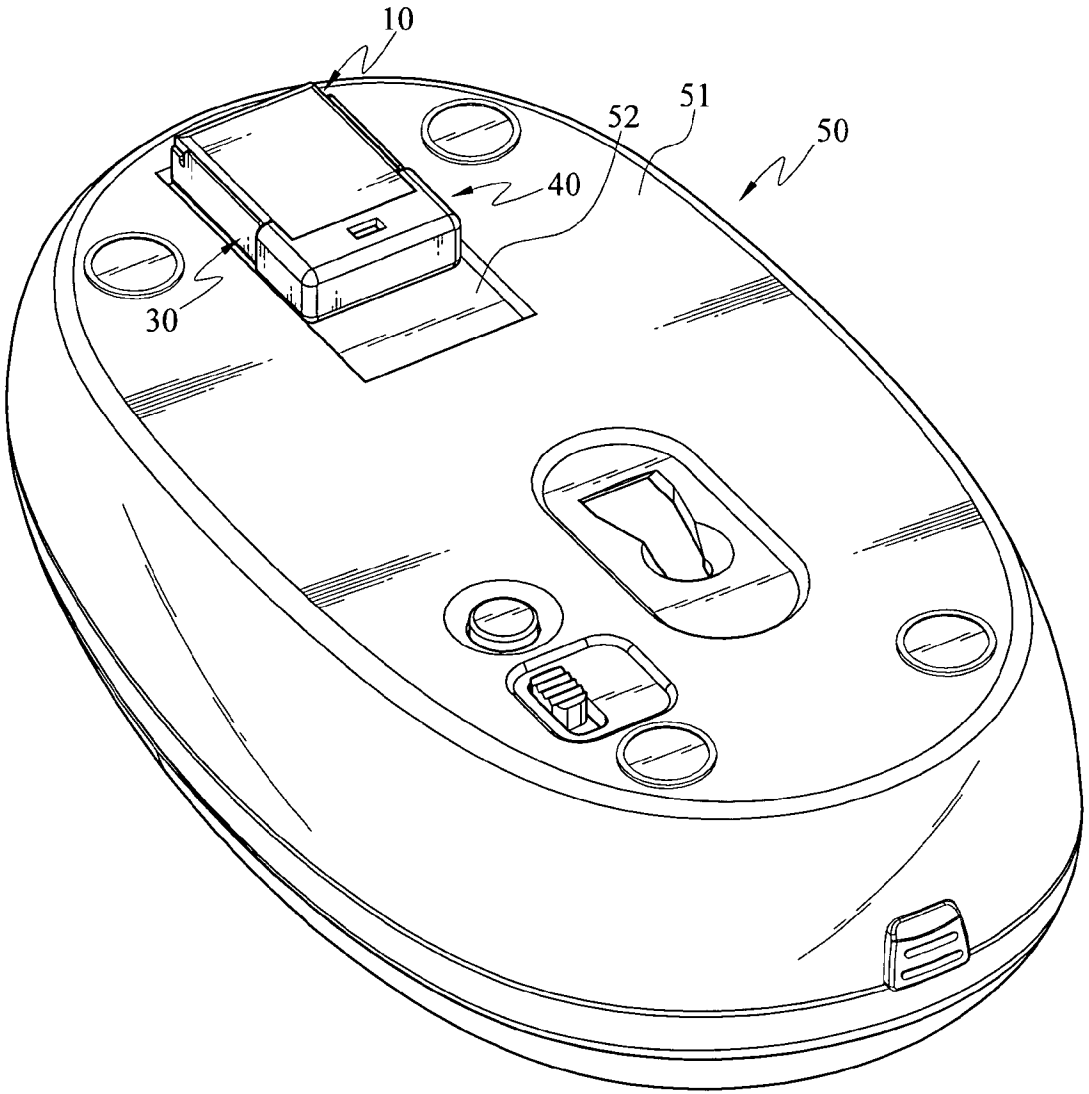

FIGS. 3A to 3C are schematic views of motions for assembling the first embodiment of the present invention to a peripheral input device. The circuit interface device according to the present invention may be assembled onto a peripheral input device 50, such as a mouse and a keyboard. In the following embodiment, a wireless mouse is taken for example, but the present invention is not limited thereto.

A sliding slot 52 is disposed in a bottom surface 51 of the peripheral input device 50, and a suspended plug 53 is disposed at one side of the sliding slot 52. The height and width of the plug 53 are slightly smaller than those of the socket 33 of the circuit interface device.

When the circuit interface device of the present invention is assembled to the peripheral input device 50, the circuit board cover 10 is inversed and placed onto the sliding slot 52, such that the socket 33 of the connector cover 30 is aligned to the plug 53. The circuit board cover 10 can be pushed along the sliding slot 52 to move towards the plug 53, and the plug 53 is inserted into the socket 33 correspondingly. In such a manner, the circuit interface device can be assembled to the bottom surface 51 of the peripheral input device 50, so as to be carried and used everywhere.

Figure 4A:
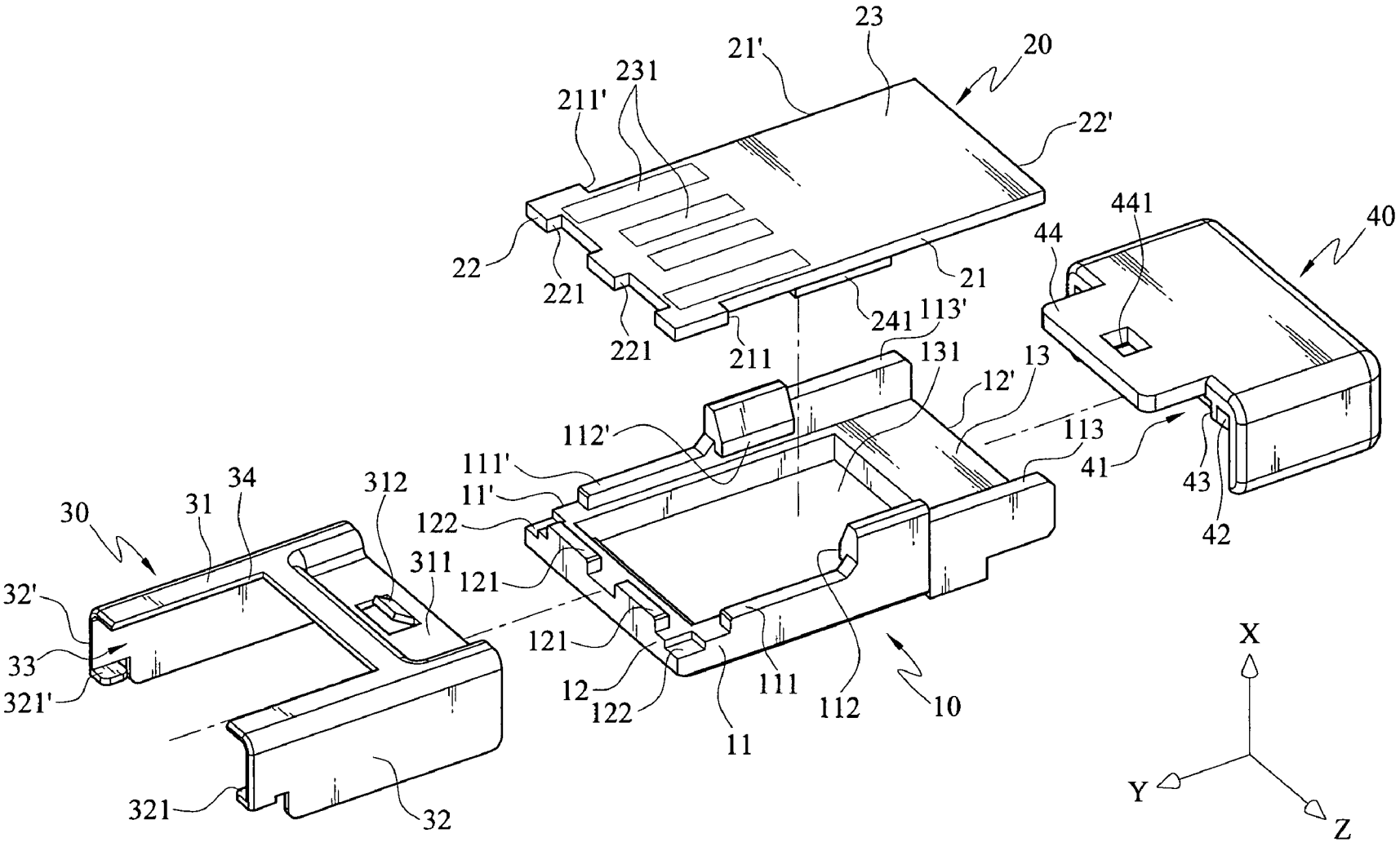
FIGS. 4A-4B are schematic exploded views according to a second embodiment of the present invention.
Figure 4B:
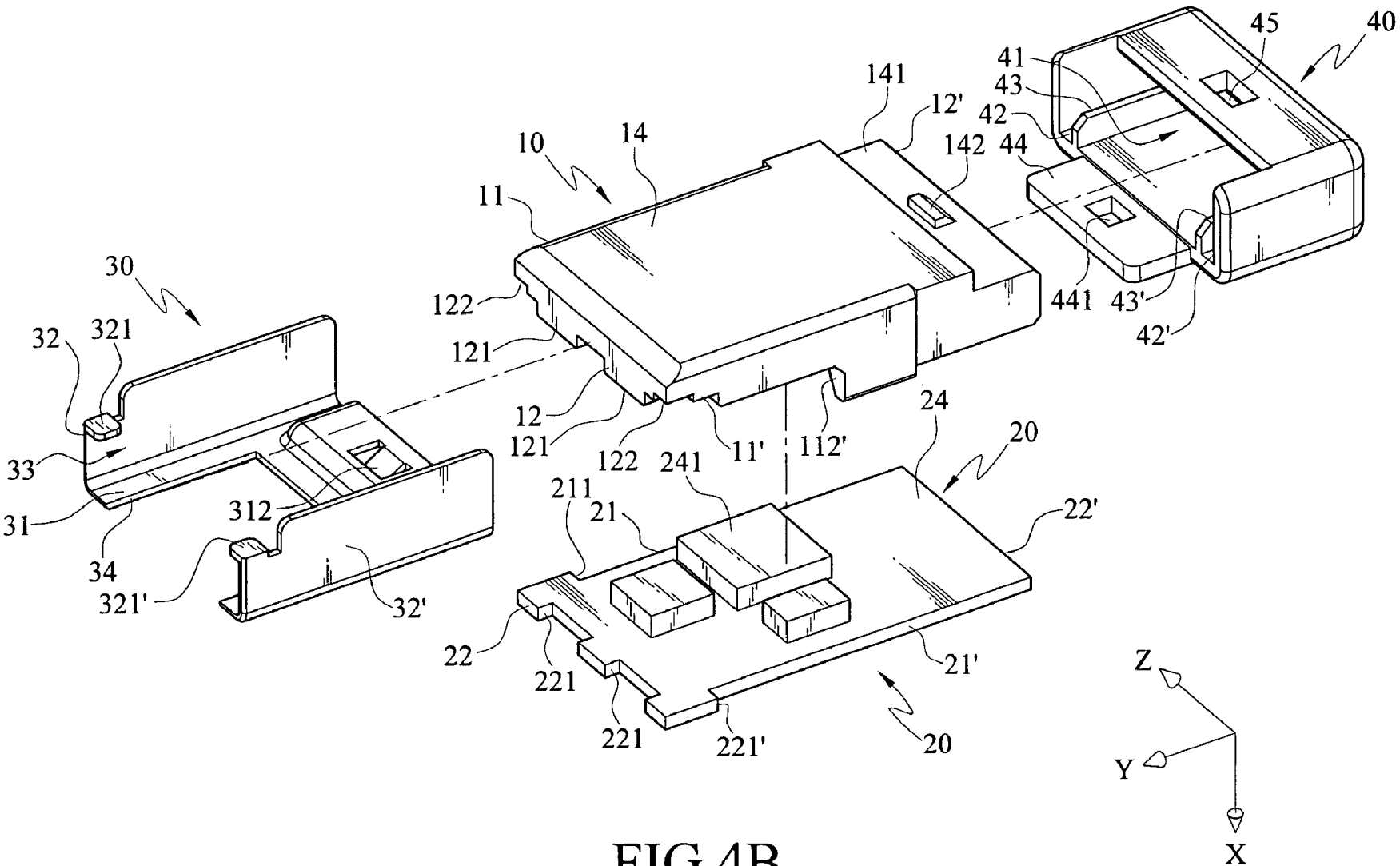

FIGS. 4A and 4B are schematic exploded views according to a second embodiment of the present invention. The specific implementation thereof is substantially the same as that of the first embodiment, and only their differences are described in the following.

Figure 5A:
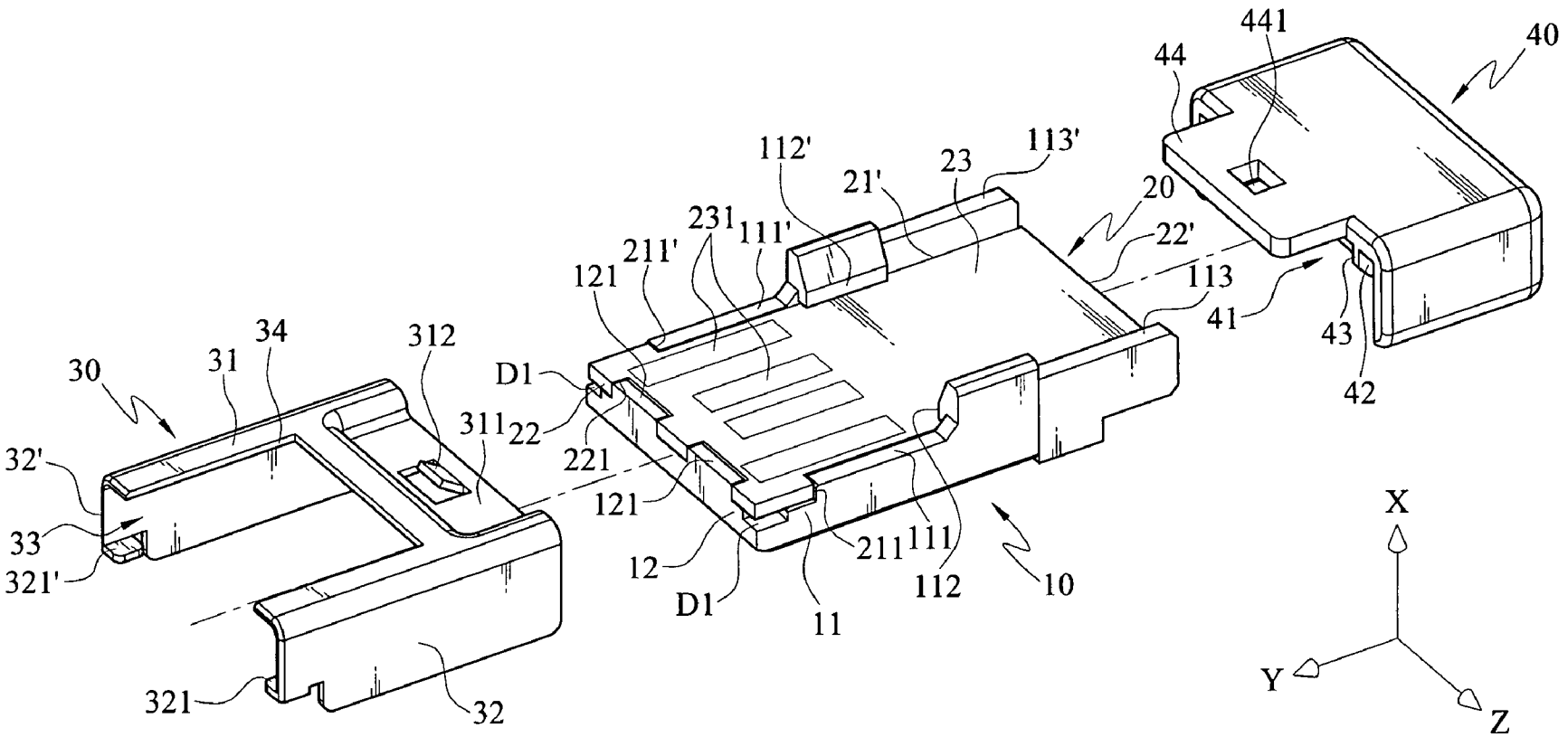
FIGS. 5A-5C are schematic views of the assembly process according to the second embodiment of the present invention.
Figure 5B:
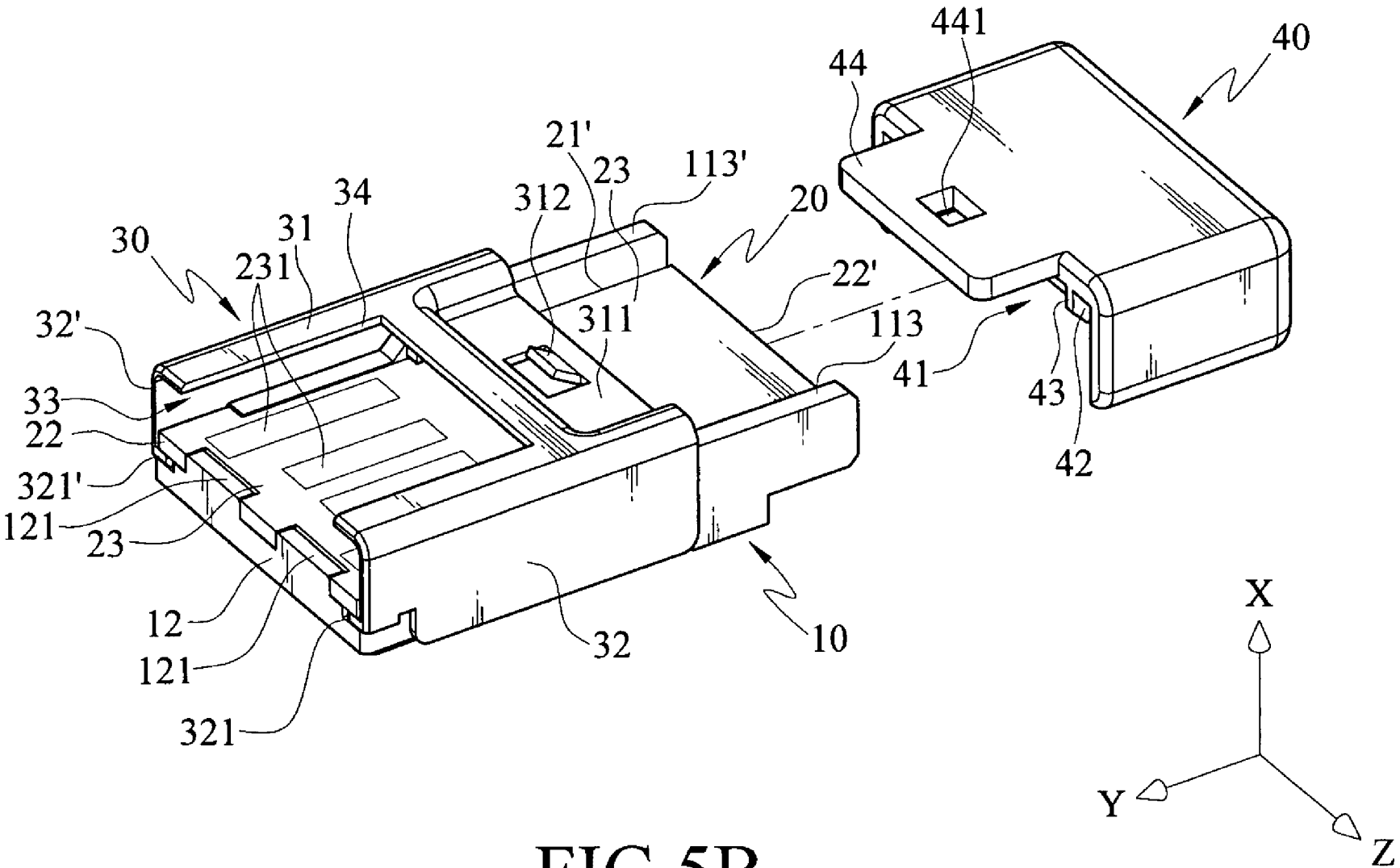
Figure 5C:
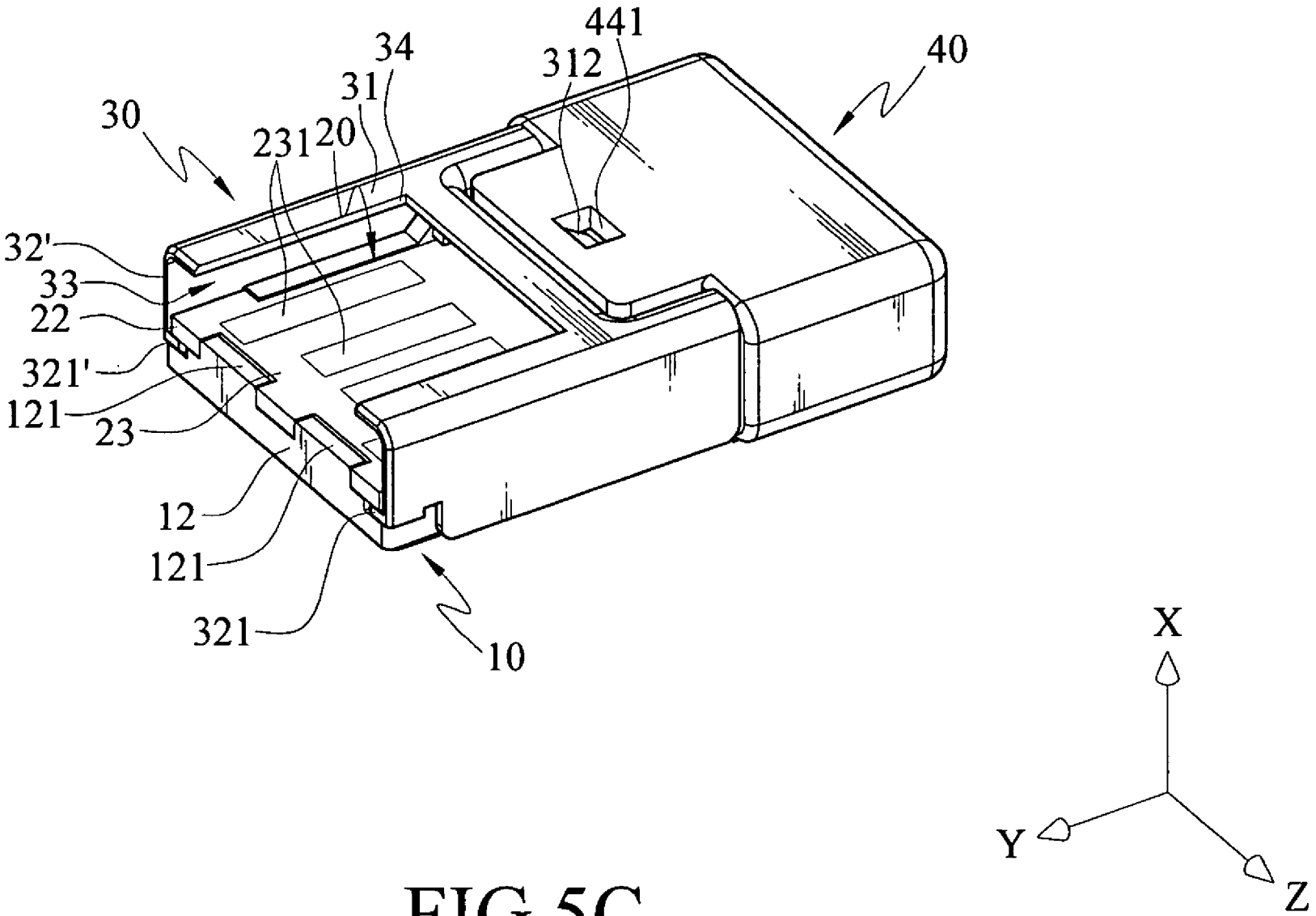

A hollow opening 34 is further opened on the base plate 31 of the connector cover 30. Referring to FIGS. 5A to 5C together, when being assembled, the circuit board 20 is mounted on the assembly plane 13 of the circuit board cover 10 along the X-axis direction, such that the hooks 112 and 112' of the circuit board cover 10 snap and position the circuit board 20 on the assembly plane 13, so as to prevent the circuit board 20 from being detached from the circuit board cover 10 along the X-axis direction again.

Next, the connector cover 30 is assembled towards the short side 12 of the circuit board cover 10 along a combining direction (as the Y-axis direction in the figures), such that the buckle pieces 321 and 321' of the connector cover 30 are inserted into the buckle space D1 (as shown in FIG. 5A) formed between the circuit board 20 and the notches 122 along the combining direction, thereby forming the connector of the USB specification.

Then, the clip cover 40 is assembled towards the short side 12' of the circuit board cover 10 along the combining direction, such that the joint groove 41 of the clip cover 40 can be smoothly joined with the joint portion 141 of the circuit board cover 10. The snap block 142 is snapped by the snap hole 45. At the same time, the connection piece 44 of the clip cover 40 is inserted into the connection slot 311 of the connector cover 30, and the catch piece 312 of the connection slot 311 is caught by the catch hole 441 on the connection piece 44.

Figure 6A:
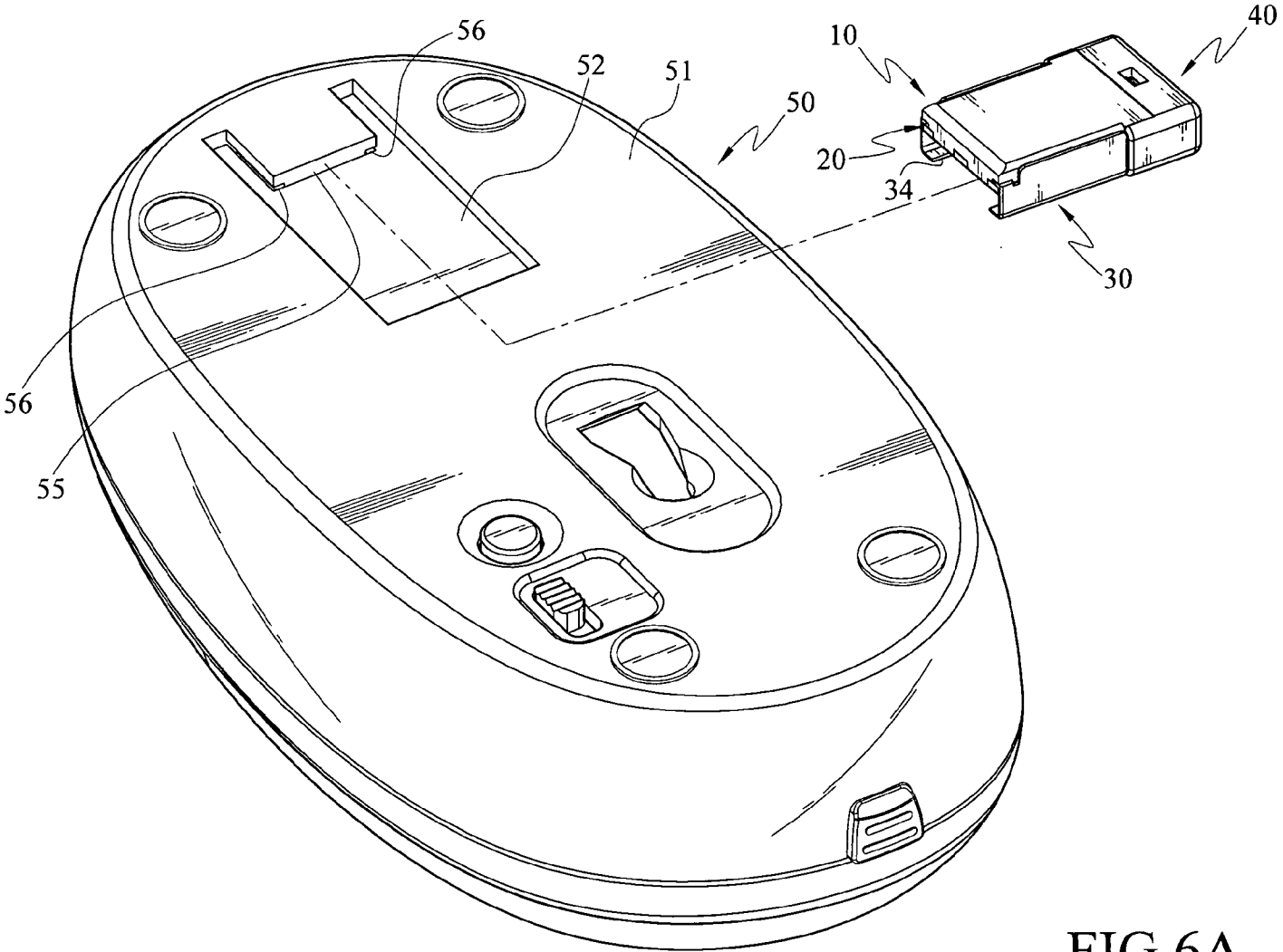
FIGS. 6A-6C are schematic views of motions for assembling the second embodiment of the present invention to a peripheral input device.
Figure 6B:
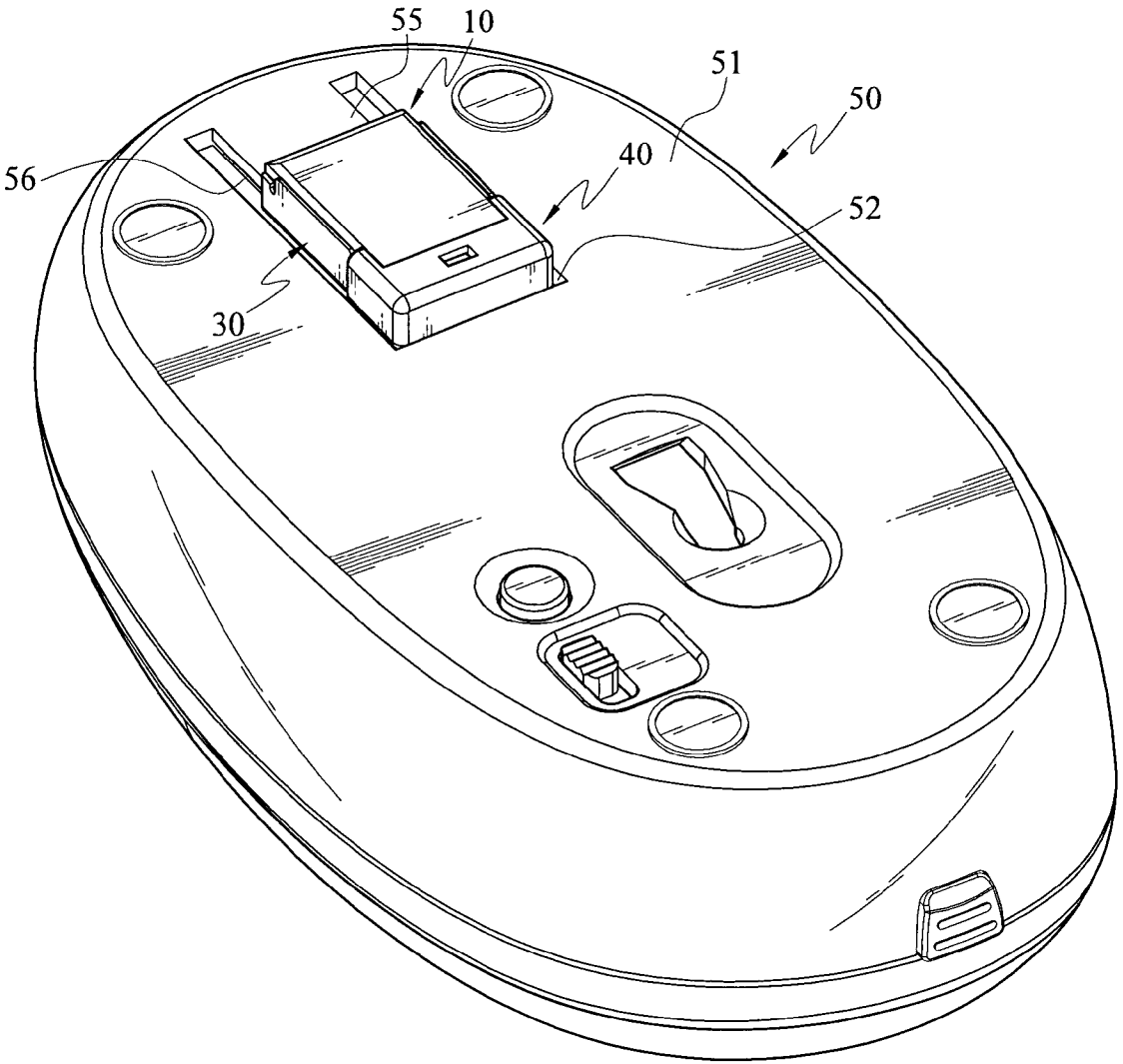
Figure 6C:
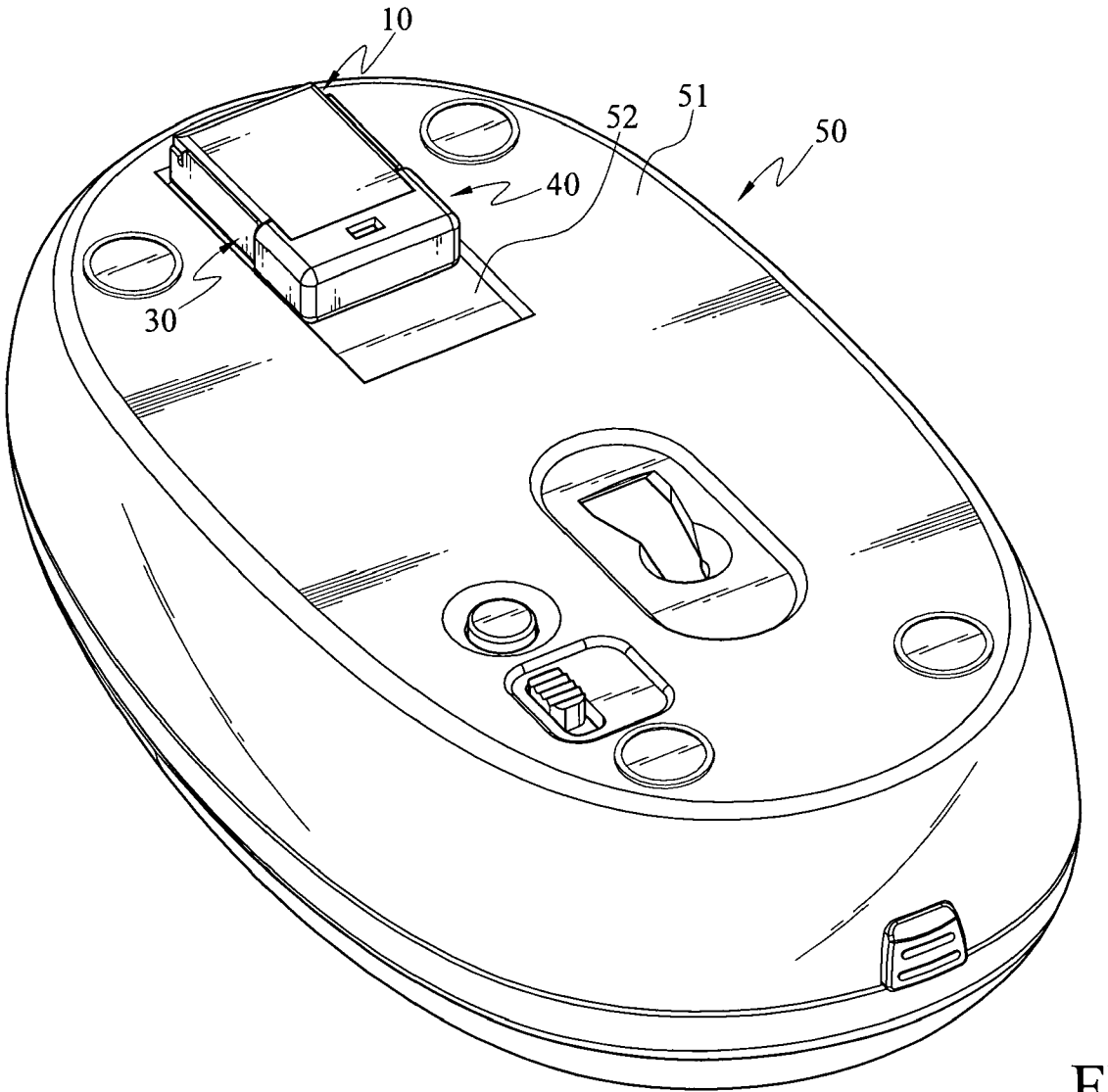

FIGS. 6A to 6C are schematic views of motions for assembling the second embodiment of the present invention to a peripheral input device. The circuit interface device according to the present invention may be assembled onto a peripheral input device 50, such as a mouse and a keyboard. In the following embodiment, a wireless mouse is taken for example, but the present invention is not limited thereto.

A sliding slot 52 is mainly disposed in a bottom surface 51 of the peripheral input device 50, and a T-shaped slide rail 55 is disposed at the end of the sliding slot 52. The height and width of the slide rail 55 are slightly smaller than those of the socket 33, and a rail slot 56 is formed at the two opposite sides of the slide rail 55.

Hence, when the circuit board cover 10 is inversed and placed into the sliding slot 52, the opening 34 opened in the base plate 31 of the connector cover 30 is towards the slide rail 55, and the circuit board cover 10 is pushed to move towards the slide rail 55, such that the slide rail 55 may extend into the socket 33 of the connector cover 30, and the portions of the two opposite sides of the opening 34 are inserted into the corresponding rail slots 56 at the same time. In such a manner, the circuit interface device can be assembled to the bottom surface 51 of the peripheral input device 50.

The efficacy of the circuit interface device according to the present invention is as follows: the length of the circuit interface device is the same as that of the circuit board, and the height of the circuit interface device is the same as the thickness of the connector cover. Since the electronic elements on the circuit board can be accommodated inside the accommodation groove of the circuit board cover after the circuit board is attached to the assembly plane of the circuit board cover, the connector cover is coupled to a front end of the circuit board to locally cover the circuit board cover, such that the connector cover forms the connector of the circuit interface device. Further, the buckle piece of the connector cover is inserted into the buckle space formed between the circuit board and the circuit board cover. As such, the thickness of the connector cover covering the bottom of the circuit board cover is reduced without completely covering the connector cover on the outer edge of the circuit board cover.

Furthermore, since the thickness of the circuit board cover is very small, and the thickness of the circuit board cover is substantially the same as that of the circuit board, the snap block that is to be corresponding snapped by the snap hole disposed at the side plate of the connector cover cannot be further disposed on the outer wall of the circuit board cover. Therefore, in the present invention, after the circuit board is mounted to the circuit board cover, a buckle space is formed between the circuit board and the circuit board cover through the notch design, and a buckle piece is formed by bending the side plate of the connector cover. As such, when the connector cover is assembled on the circuit board, the buckle piece can be correspondingly inserted into the buckle space, so as to achieve a firm and compact fixed structure between the connector cover and the circuit board.

What is claimed is:

1. A circuit interface device, applied to an electronic device having a circuit interface socket, the circuit interface device comprising:

a connector cover;

a circuit board cover;

a circuit board, disposed on the circuit board cover, wherein at least one electronic element is disposed on two sides of the circuit board respectively, and a plurality of electrical contacts is disposed on a side surface of the circuit board; and a clip cover, wherein the clip cover is disposed at one side of the circuit board cover and is away from the electrical contacts, and the clip cover is buckled onto the circuit board cover and the connector cover respectively;

wherein the connector cover is coupled to a front end of the circuit board, such that the connector cover and the circuit board form a connector, and the circuit interface device is inserted into the circuit interface socket with the connector.

2. The circuit interface device according to claim 1, wherein the circuit board cover has an assembly plane, an accommodation groove is disposed on the assembly plane, and the electronic element of the circuit board is accommodated in the accommodation groove.

3. The circuit interface device according to claim 1, wherein at least one notch is disposed on the circuit board cover, after the circuit board is secured by the circuit board cover, a buckle space is formed between the circuit board and the notch, the connector cover has a side plate formed by bending two opposite sides of a base plate, and a buckle piece is formed by inwardly bending one side of the substrate respectively; the connector cover is coupled to a front end of the circuit board by inserting the buckle piece into the buckle space.

4. The circuit interface device according to claim 1, wherein at least one insertion block is disposed on at least one side of the circuit board cover, at least one insertion groove is disposed on the circuit board, and the insertion groove of the circuit board is inserted on the insertion block of the circuit board cover correspondingly.

5. The circuit interface device according to claim 1, wherein a hook extends upwardly from one of the two opposite sides of the circuit board cover respectively, and the hooks hook and position the circuit board onto the circuit board cover.

6. The circuit interface device according to claim 1, wherein an interior of the clip cover has a joint groove, at least one snap hole is disposed at one side of the clip cover, a joint portion is disposed on one side of the circuit board cover opposite to the joint groove, at least one snap block is disposed on the joint portion, and the clip cover is joined onto the joint portion with the joint groove, such that the snap block is snapped by the snap hole.

7. The circuit interface device according to claim 1, wherein a connection piece extends from one side of the clip cover, at least one catch hole is disposed on the connection piece, a connection slot is opened on a side of the connector cover, at least one catch piece is disposed in the connection slot, and the clip cover is inserted onto the connection slot with the connection piece, such that the catch piece is caught by the catch hole and positioned.

8. The circuit interface device according to claim 1, wherein a socket is disposed on one end of the connector cover, and the socket is corresponding to an upper side of the electrical contacts of the circuit board.

9. A circuit interface device, comprising:

a connector cover, having at least one buckle piece at a front end;

a circuit board;

a circuit board cover; and a clip cover;

wherein the circuit board is secured by the circuit board cover, the buckle piece of the connector cover is coupled to a front end of the circuit board, and the clip cover at the rear end of the circuit board is respectively coupled to the circuit board cover and the rear end of the connector cover accordingly.

10. The circuit interface device according to claim 9, wherein at least one notch is disposed on the circuit board cover, a buckle space is formed between the circuit board and the notch, and the buckle piece is correspondingly extended from the connector cover; the buckle piece is inserted into the buckle space and secured between the circuit board and the circuit board cover.

* * * * *